US006389937B1

(12) United States Patent
Kang

(10) Patent No.: US 6,389,937 B1
(45) Date of Patent: May 21, 2002

(54) UNIVERSAL GRIP PLIERS

(76) Inventor: Hsin-Fa Kang, P.O. Box 90, Tainan (TW)

( * ) Notice: Subject to any disclaimer, the term of this patent is extended or adjusted under 35 U.S.C. 154(b) by 0 days.

(21) Appl. No.: 09/883,304

(22) Filed: Jun. 19, 2001

(51) Int. Cl.[7] ..... B25B 7/02
(52) U.S. Cl. ..... 81/423; 81/424.5
(58) Field of Search ..... 81/423, 424.5, 81/417, 416, 176.15, 176.2, 176.3

(56) References Cited

U.S. PATENT DOCUMENTS 1,119,532 A * 12/1914 Parks ..... 81/415
3,383,963 A * 5/1968 Vondrachek ..... 81/423
6,016,594 A * 1/2000 Frey ..... 29/402.08

* cited by examiner

*Primary Examiner*—Joseph J. Hail, III
*Assistant Examiner*—David B. Thomas

(57) ABSTRACT

A pair of universal grip pliers includes a first shank body and a second shank body joined together by a pivot member and having two handles each respectively fixed by fastening members at the lower portions, a spring disposed therein for oppositely stretching the two handles outwardly and two arms each respectively formed in the upper portions. A male jaw and a female jaw each respectively pivoted on the inside of the top of the arms of the first shank body and the second shank body can oppositely grip each other to tightly clamp a pipe with smaller diameter by allowing tongued portions disposed in both sides of the male jaw to cross over grooved portions of the female jaw without touching against the endwalls of the grooved portions, which is suitable to assemble and/or disassemble pipes with different diameters and can be used in different working space.

5 Claims, 4 Drawing Sheets

UNIVERSAL GRIP PLIERS

BACKGROUND OF THE INVENTION

1. Field of the Invention

This invention relates to a pair of universal grip pliers, particularly to one including a male jaw and a female jaw capable of oppositely gripping each other, by allowing tongued portions disposed in both sides of the male jaw to cross over grooved portions of the female jaw so that the tongued portions of the male jaw will not touch against the endwalls of the grooved portions of the female jaw and the pair of universal grip pliers in the present invention is capable of fixedly clamping a pipe with smaller diameter and easy to assemble and/or disassemble pipes with different diameters. Moreover, the male and female jaws are capable of rotating with 360 degrees and clamping pipes at free angles, which is very convenient for using in different working space.

2. Description of the Prior Art

As shown in FIG. 1, a pair of known conventional grip pliers includes a first shank body 90 and a second shank body 91 joined together by a pivot member 92 and having two handles 93, 94 each respectively disposed at the bottom and two opposite curved jaws 95, 96 each respectively disposed at the top, by which a user can extend the two handles 93, 94 outwardly to open the two opposite curved jaws 95, 96 for clamping a pipe. However, the known conventional two opposite curved jaws 95, 96 are designed to have only one fixed inside diameter in their closing condition. Under the situation, if the user wants to grip a pipe with smaller diameter, he has no choice but to change another pair of grip pliers with new two opposite curved jaws 95, 96 suitable to the smaller pipe, which is very inconvenient for the user in the case that he has to replace many pipes or hoses of a car with different diameters, such as fuel tubes, water hoses, brake lines, air hoses and connector tubes, etc.

SUMMARY OF THE INVENTION

The main purpose of the invention is to offer a pair of universal grip pliers for easily assembling and/or disassembling pipes with different diameters and being suitably used in different working space.

The main feature of the invention is to provide a pair of universal grip pliers having a male jaw pivoted on the inside of the top of an arm of a first shank body and a female jaw pivoted on the inside of the top of an arm of a second shank body; the male jaw having tongued portions disposed in both sides and the female jaw having grooved portions disposed in both sides with positions corresponding to the tongued portions of the male jaw.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
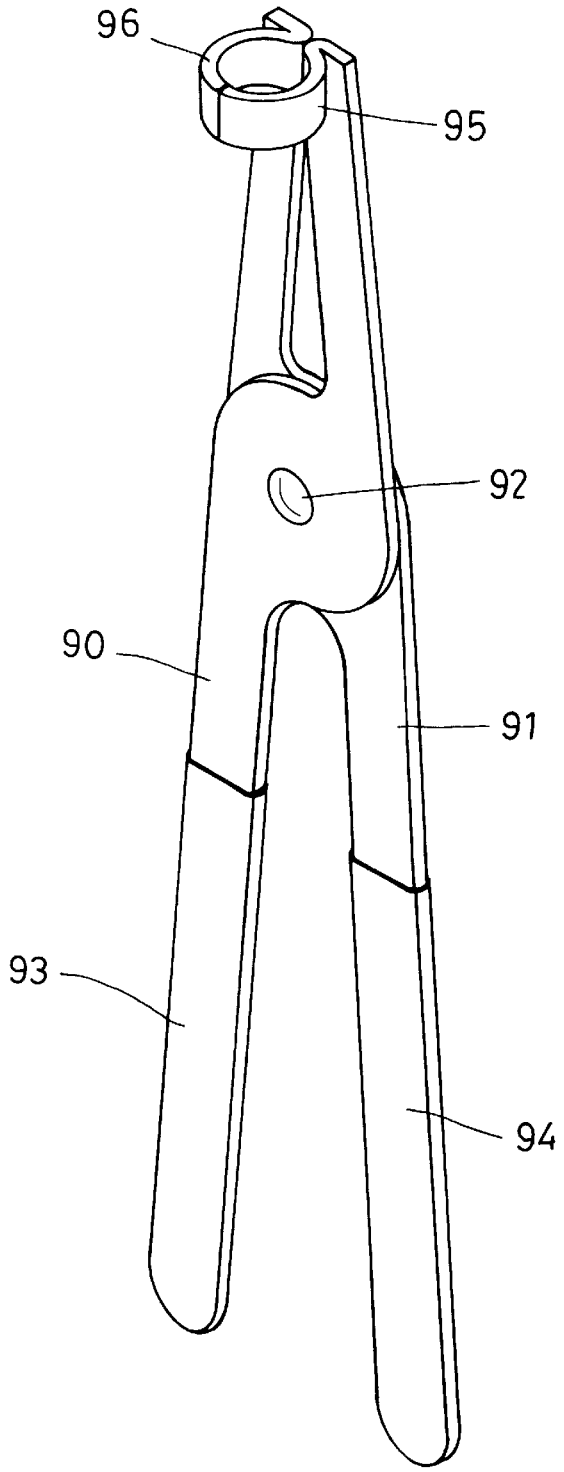
FIG. 1 (PRIOR ART)
FIG. 1 is a perspective view of a pair of known conventional universal grip pliers.
Figure 2:
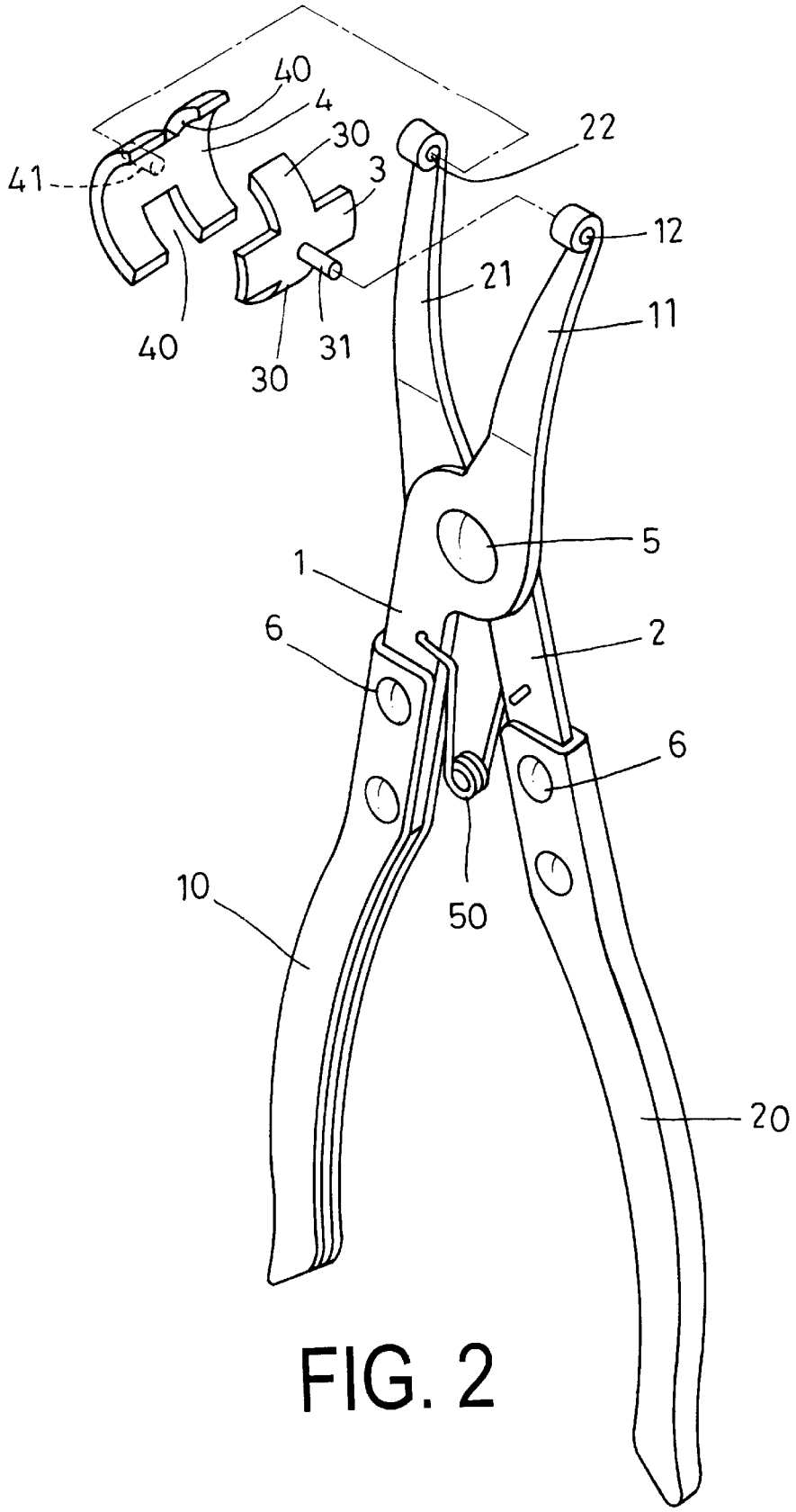
FIG. 2 is an exploded perspective view of a pair of universal grip pliers in the present invention.

A preferred embodiment of a pair of universal grip pliers in the present invention, as shown in FIG. 2, includes a first shank body 1, a second shank body 2, a male jaw 3 and a female jaw 4. The first shank body 1 and the second shank body 2 joined together by a pivot member 5 in the middle portion have two handles 10, 20 each respectively fixed by fastening members 6 at the lower portions, two arms 11, 21 each respectively formed in the upper portions and a spring 50 disposed between the first shank body 1 and the second shank body 2 with the function of oppositely stretching the two handles 10, 20 outwardly. The two arms 11, 21 formed with curved configuration in the upper portions have holes 12, 22 each respectively arranged on the top of the upper portions. The male jaw 3 pivoted on the inside of the top of the arm 11 of the first shank body 1 has tongued portions 30 disposed in both sides and a post 31 arranged on the outside wall. The female jaw 4 pivoted on the inside of the top of the arm 12 of the second shank body 2 has grooved portions 40 disposed in both sides with positions corresponding to the tongued portions 30 of the male jaw 3 and a post 41 arranged on the outside wall.

Figure 3:
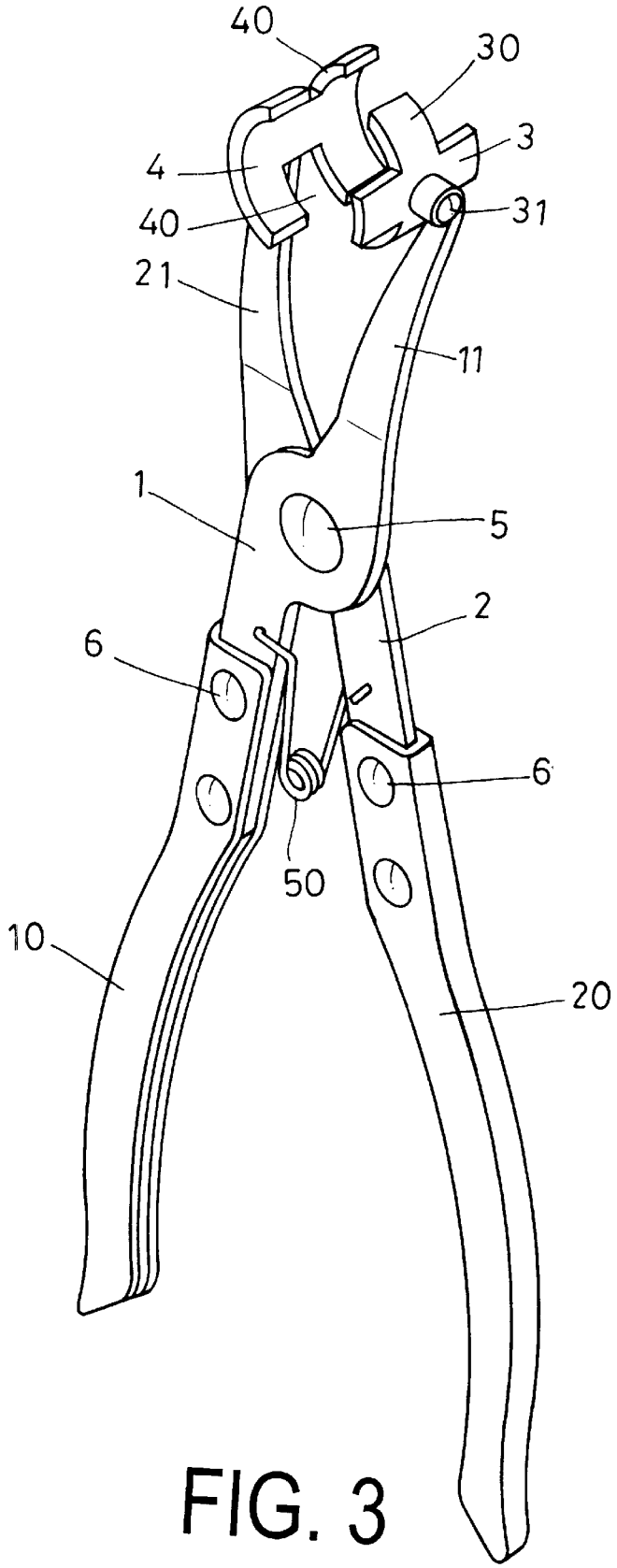
FIG. 3 is a perspective view of the pair of universal grip pliers in the present invention.

In assembling, referring to FIGS. 2 and 3, firstly extend the outer end of the post 31 of the male jaw 3 through the hole 12 of the arm 11 of the first shank body 1 and rivet it on the arm 11 of the first shank body 1 so that the male jaw 3 is fixedly pivoted on the first shank body 1. Secondly, extend the outer end of the post 41 of the female jaw 4 through the hole 22 of the arm 21 of the second shank body 2 and rivet on the arm 21 of the second shank body 2 so that the female jaw 4 is fixedly pivoted on the second shank body 2. The male jaw 3 and the female jaw 4 are arranged in an opposite relationship. Finally, the first shank body 1 and the second shank body 2 are pivoted together, by which the pair of universal grip pliers in the present invention is assembled easily and quickly. Besides the reveting way, the male jaw 3 and the female jaw 4 are permitted to be pivoted respectively on the arms 11, 21 of the first shank body 1 and the second shank body 2 with retainer rings.

Figure 4:
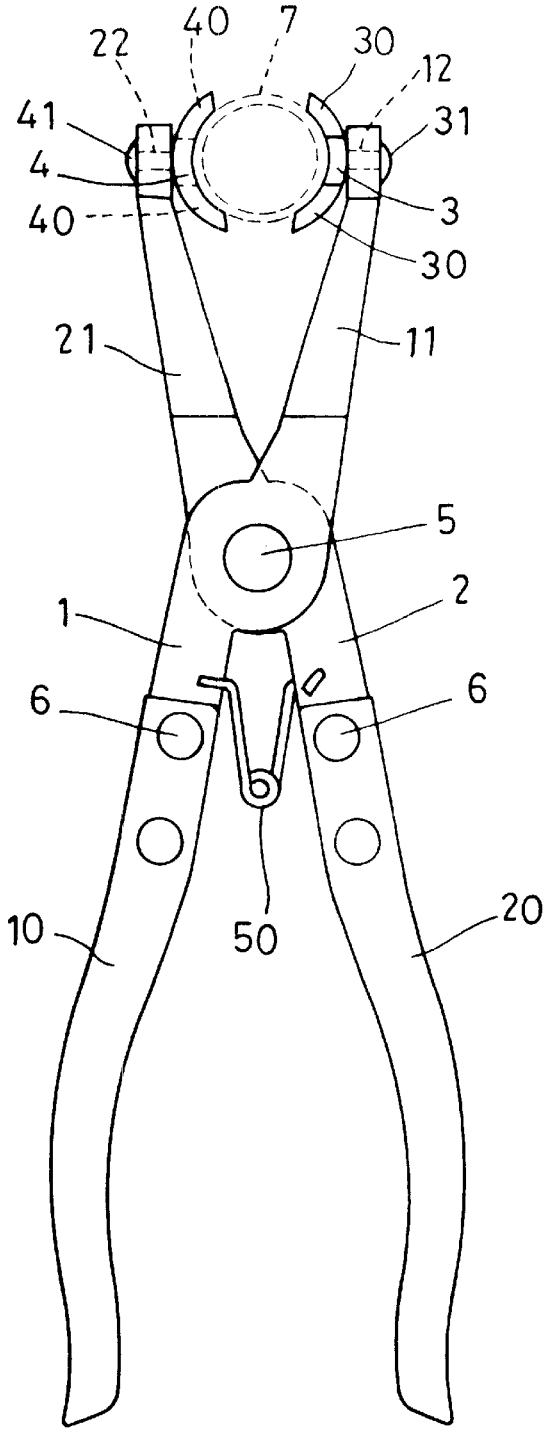
FIG. 4 is a schematic view of the pair of universal grip pliers in the present invention, showing that a male jaw and a female jaw of the pair of universal grip pliers clamp a pipe with larger diameter; and, FIG. 5 is a schematic view of the pair of universal grip pliers in the present invention, showing that the male and female jaws of the pair of universal grip pliers clamp a pipe with smaller diameter.
Figure 5:
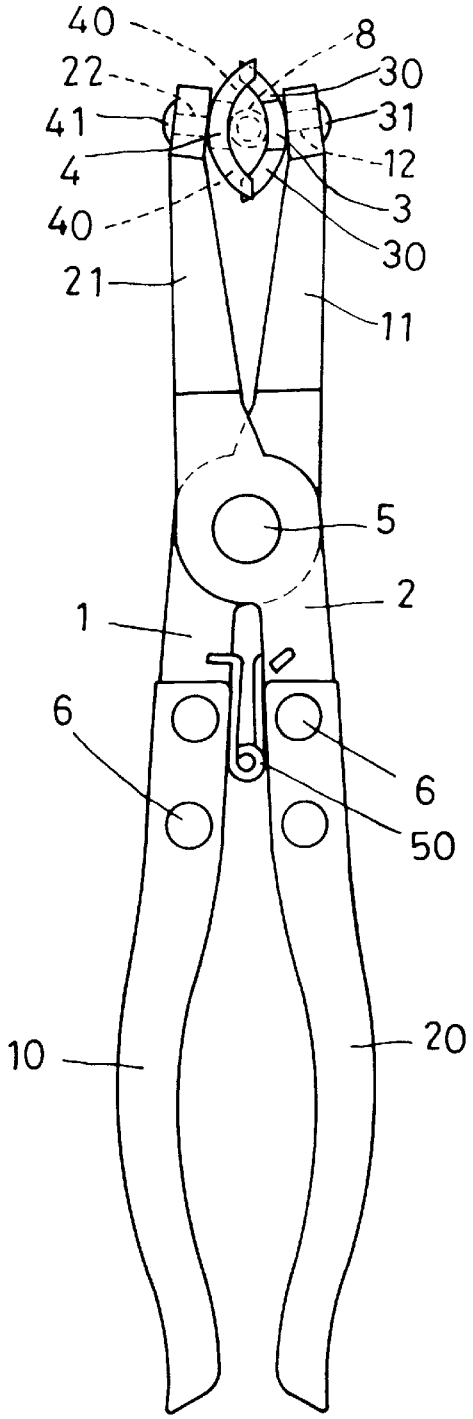

In using, referring to FIG. 4, the torsion spring 50 disposed between the first shank body 1 and the second shank body 2 will oppositely stretch the two handles 10, 20 and the two arms 11, 22 outwardly, by which the male jaw 3 and the female jaw 4 are also stretched outwardly to form an opening therein for clamping a pipe 7. When assembling and/or disassembling the pipe 7 with larger diameter, a user may hold and force the two handles 10, 20 of the first shank body 1 and the second shank body 2 to move inwardly so as to make the inside walls of the male jaw 3 and the female jaw 4 move closely and clamp the outside wall of the pipe 7 tightly. Similarly, when assembling and/or disassembling a pipe 8 with smaller diameter, the user may hold and force the two handles 10, 20 of the first shank body 1 and the second shank body 2 to move inwardly so as to make the inside walls of the male jaw 3 and the female jaw 4 move closely and clamp the outside wall of the pipe 8 tightly, as shown in FIG. 5. However, if the diameter of the pipe 8 is smaller than the inside diameter of the combined male jaw 3 and female jaw 4, the user is allowed to force the two handles 10, 20 of the first shank body 1 and the second shank body 2 to move more inwardly, by which the tongued portions 30 of the male jaw 3 will cross over the grooved portions 40 of the female jaw 4 so as to decrease the inside diameter of the combined male jaw 3 and female jaw 4 and clamp the outside wall of the pipe 8 tightly without touching against the endwalls of the grooved portions 40 of the female jaw 4. In such a way, when assembling and/or disassembling a pipe with a diameter smaller than the inside diameter of the combined male jaw 3 and female jaw 4, the user does not need to replace another pair of grip pliers. Therefore, the pair of universal grip pliers in the present invention is suitable to assemble and/or disassemble pipes with different diameters. Moreover, the two arms 11, 21 formed with curved configuration in the upper portions are very convenient to be inserted into various apparatuses for assembling and/or disassembling pipes. The male and female jaws 3, 4 each respectively pivoted on the first shank body 1 and the second shank body 2 are capable of rotating with 360 degrees and clamping pipes at free angles, which is very convenient for using in different working space.

While the preferred embodiment of the invention has been described above, it will be recognized and understood that various modifications may be made therein and the appended claims are intended to cover all such modifications that may fall within the spirit and scope of the invention.

What is claimed is:

1. A pair of universal grip pliers comprising a first shank body and a second shank body joined together by a pivot member and having two handles each respectively fixed by fastening members at the lower portions and two arms each respectively formed in the upper portions;

characterized by a male jaw pivoted on the inside of the top of said arm of said first shank body and having tongued portions disposed in both sides, and a female jaw pivoted on the inside of the top of said arm of said second shank body and having grooved portions disposed in both sides with positions corresponding to said tongued portions of said male jaw;

whereby said male and said female jaws are capable of oppositely gripping each other to tightly clamp a pipe with smaller diameter by allowing said tongued portions of said male jaw to cross over said grooved portions of said female jaw without touching against endwalls of said grooved portions of said female jaw so that said pair of universal grip pliers of the present invention is suitable to assemble and/or disassemble pipes with different diameters, and said male and female jaws are capable of rotating with free angles for using in different working space.

2. A pair of universal grip pliers as claimed in claim 1, wherein said arms of said first shank body and said second shank body are formed with curved configuration in the upper portions.

3. A pair of universal grip pliers as claimed in claim 1, wherein two holes are each respectively arranged on the top of the upper portions of said arms of said first shank body and said second shank body; two posts are each respectively disposed on the outside walls of said male jaw and said female jaw for extending through and being riveted on said holes of said arms of said first shank body and said second shank body.

4. A pair of universal grip pliers as claimed in claim 3, wherein said male jaw and said female jaw are capable of being pivoted respectively on said arms of said first shank body and said second shank body with retainer rings.

5. A pair of universal grip pliers as claimed in claim 1, wherein a spring is disposed between said first shank body and said second shank body to oppositely stretch said two handles outwardly.

* * * * *